US008807928B2

(12) United States Patent
Kareff et al.

(10) Patent No.: US 8,807,928 B2
(45) Date of Patent: Aug. 19, 2014

(54) TIP SHROUD ASSEMBLY WITH CONTOURED SEAL RAIL FILLET

(75) Inventors: Spencer Aaron Kareff, Greenville, SC (US); Jason Herzlinger, Greenville, SC (US); Harish Bommanakatte, Karnataka (IN)

(73) Assignee: General Electric Company, Schenectady, NY (US)

( * ) Notice: Subject to any disclaimer, the term of this patent is extended or adjusted under 35 U.S.C. 154(b) by 449 days.

(21) Appl. No.: 13/252,237

(22) Filed: Oct. 4, 2011

(65) Prior Publication Data

US 2013/0084169 A1 Apr. 4, 2013

(51) Int. Cl.

| | |
|---|---|
| ***F01D 11/00*** | (2006.01) |
| ***F01D 5/20*** | (2006.01) |
| ***F01D 5/14*** | (2006.01) |
| ***F01D 5/22*** | (2006.01) |

(52) U.S. Cl.

CPC *F01D 5/225* (2013.01); *F01D 5/20* (2013.01); *F01D 5/147* (2013.01); *F01D 5/143* (2013.01); *F01D 11/001* (2013.01)

USPC ..... 415/173.6; 416/191; 416/192

(58) Field of Classification Search

USPC ..... 415/173.6; 416/191, 192

See application file for complete search history.

(56) References Cited

U.S. PATENT DOCUMENTS

| | | | | |
|---|---|---|---|---|
| 6,241,471 | B1 | 6/2001 | Herron | |
| 6,491,498 | B1 | 12/2002 | Seleski et al. | |
| 6,857,853 | B1 | 2/2005 | Tomberg et al. | |
| 7,001,144 | B2 | 2/2006 | Urban et al. | |
| 7,001,152 | B2 | 2/2006 | Paquet et al. | |
| 7,063,509 | B2 | 6/2006 | Snook et al. | |
| 7,094,023 | B2 | 8/2006 | Dube et al. | |
| 7,762,779 | B2 * | 7/2010 | Zemitis et al. | 416/191 |
| 7,887,295 | B2 | 2/2011 | Brittingham et al. | |
| 2005/0036890 | A1 | 2/2005 | Tomberg et al. | |
| 2005/0129519 | A1 | 6/2005 | Beddard et al. | |
| 2008/0038116 | A1 | 2/2008 | Zemitis et al. | |
| 2008/0292466 | A1 | 11/2008 | Tragesser et al. | |
| 2009/0053047 | A1 | 2/2009 | Chiurato et al. | |
| 2011/0002777 | A1 | 1/2011 | Smith | |

* cited by examiner

*Primary Examiner* — Edward Look
*Assistant Examiner* — Danielle M Christensen
(74) *Attorney, Agent, or Firm* — Sutherland Asbill & Brennan LLP

(57) ABSTRACT

The present application provides a tip shroud assembly for use with a turbine engine. The tip shroud assembly may include a shroud, a seal rail positioned on the shroud, and a contoured fillet attaching the seal rail to the shroud.

16 Claims, 3 Drawing Sheets

TIP SHROUD ASSEMBLY WITH CONTOURED SEAL RAIL FILLET

TECHNICAL FIELD

The present application and the resultant patent relate generally to gas turbine engines and more particularly relate to a contoured seal rail fillet for use on a turbine blade tip shroud assembly for reduced stresses with a minimal increase in weight and material.

BACKGROUND OF THE INVENTION

Generally described, gas turbine buckets often include an airfoil with an integral tip shroud attached thereto. The tip shroud attaches to the outer edge of the airfoil and provides a surface that runs substantially perpendicular to the airfoil surface. The surface area of the tip shroud helps to hold the turbine exhaust gases on the airfoil such that a greater percentage of the energy from the turbine exhaust gases may be converted into mechanical energy so as to increase overall turbine efficiency. The tip shroud also provides aeromechanical damping and shingling (fretting) prevention to the airfoil.

A seal rail may be used on the tip shroud as a sealing feature with respect to the hot gases flowing thereover. The seal rail may be attached to the shroud with a fillet and may terminate at a Z-notch intersection on one or both ends. The relatively high temperature environment and the bending stresses caused by the overhanging material and centrifugal loading on the tip shroud, however, may drive creep (deformation) therein. Specifically, these bending stresses and the like may cause localized high stress concentrations in the Z-notch intersections and elsewhere. Using a larger fillet to attach the seal rail may help reduce such Z-notch stresses but at the cost of increasing the overhung mass of the shroud.

There is thus a desire for an improved tip shroud assembly. Such an improved tip shroud assembly may use an expanded fillet to attach the seal rail to the shroud so as to reduce the stresses at the Z-notches and elsewhere, but while adding only a small amount of additional mass so as to improve the overall lifespan of the bucket and the components thereof.

SUMMARY OF THE INVENTION

The present application and the resultant patent thus provide a tip shroud assembly for use with a turbine engine. The tip shroud assembly may include a shroud, a seal rail positioned on the shroud, and a contoured fillet attaching the seal rail to the shroud.

The present application and the resultant patent further may provide a tip shroud assembly for use with a turbine engine. The tip shroud assembly may include a shroud with a first end Z-notch and a second end Z-notch, a seal rail positioned on the shroud, and a first contoured fillet on a first side of the seal rail and a second contoured fillet on a second side of the seal rail. The first contoured fillet may include a Z-notch section about the first end Z-notch and a linear section about the second end Z-notch.

The present application and the resultant patent further may provide a tip shroud assembly for use with a turbine engine. The tip shroud assembly may include a shroud with a first end Z-notch and a second end Z-notch, a seal rail positioned on the shroud, and a first contoured fillet on a first side of the seal rail and a second contoured fillet on a second side of the seal rail in a reciprocal orientation. The first contoured fillet may include a number of Z-notch radii expanding the direction of the first end Z-notch and a number of substantially uniform linear radii about the second end Z-notch.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
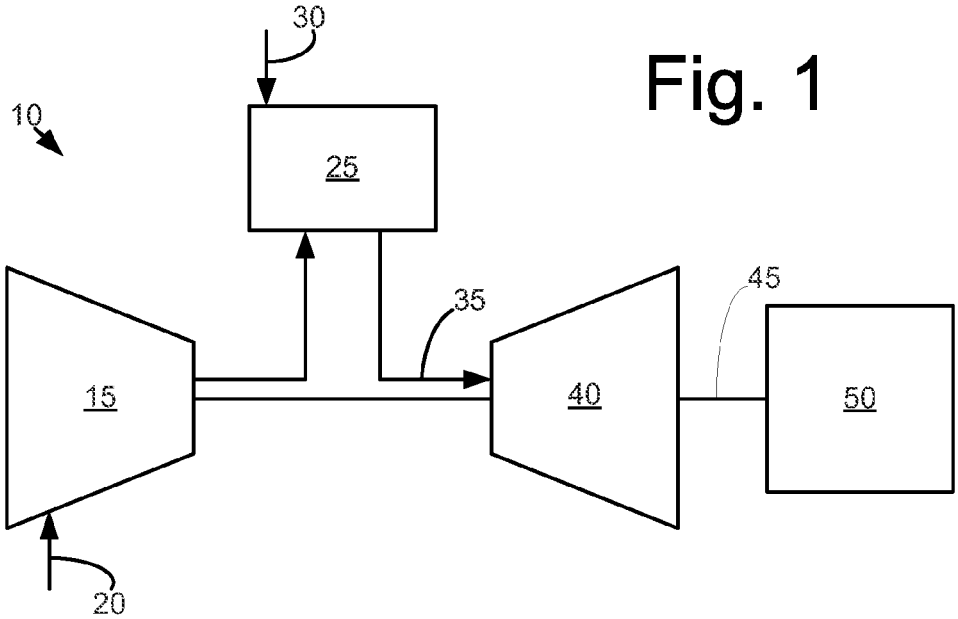
FIG. 1 is a schematic diagram of a gas turbine engine.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a compressed flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, and/or other types of fuels. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
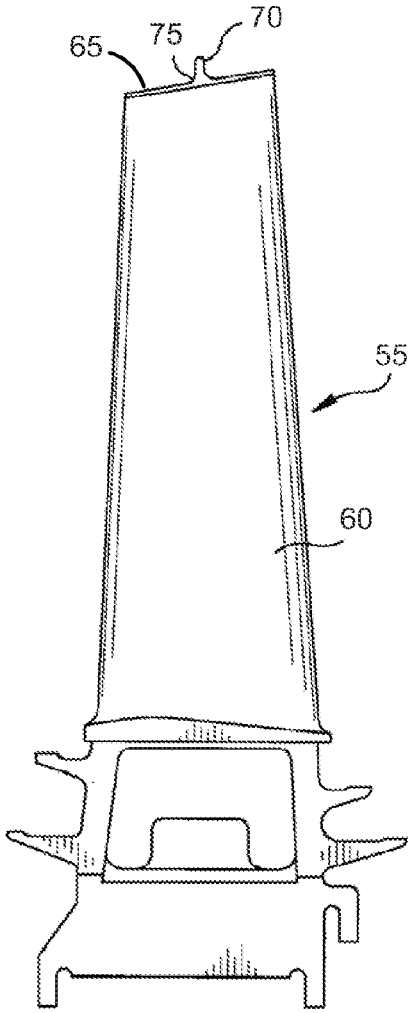
FIG. 2 is a side view of a known turbine bucket having a tip shroud thereon.

FIG. 2 shows an example of a turbine bucket 55 that may be used with the turbine 40. Generally described, the turbine bucket 55 includes an airfoil 60. The airfoil 60 is the active component that intercepts the flow of combustion gases 35 to convert the energy of the combustion gases 35 into tangential motion. A tip shroud 65 may be positioned at the top of the airfoil 60. The size and shape of the tip shroud 65 may vary. Positioned along the top of the tip shroud 65 may be a seal rail 70. As was described above, the seal rail 70 prevents or limits the passage of the combustion gases 35 through a gap between the tip shroud 65 and the inner surface of the surrounding components. The size and shape of the seal rail 70 may vary. The seal rail 70 may be attached to the tip shroud 65 via a pair of fillets 75. The fillets 75 generally are linear and uniform in shape along the length of the tip shroud 65. Other components and other configurations may be used herein.

Figure 3:
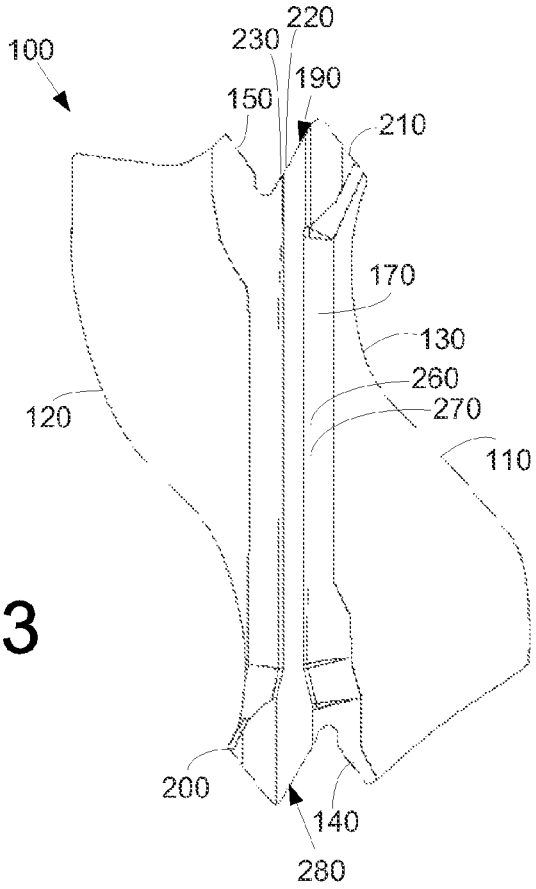
FIG. 3 is a top plan view of a tip shroud assembly as may be described herein.
Figure 4:
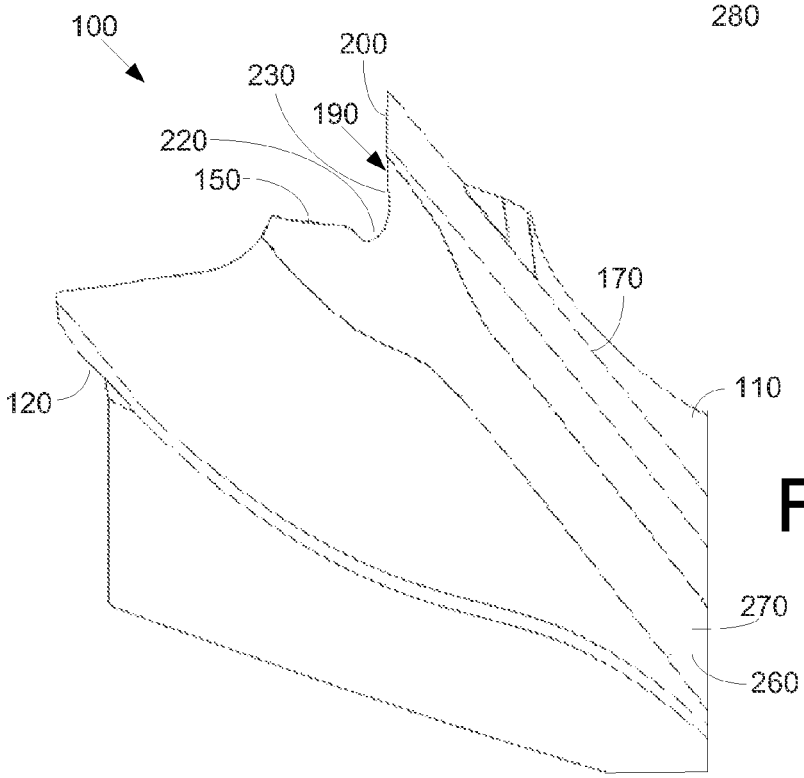
FIG. 4 is a side perspective view of a first side of the tip shroud assembly of FIG. 3.
Figure 5:
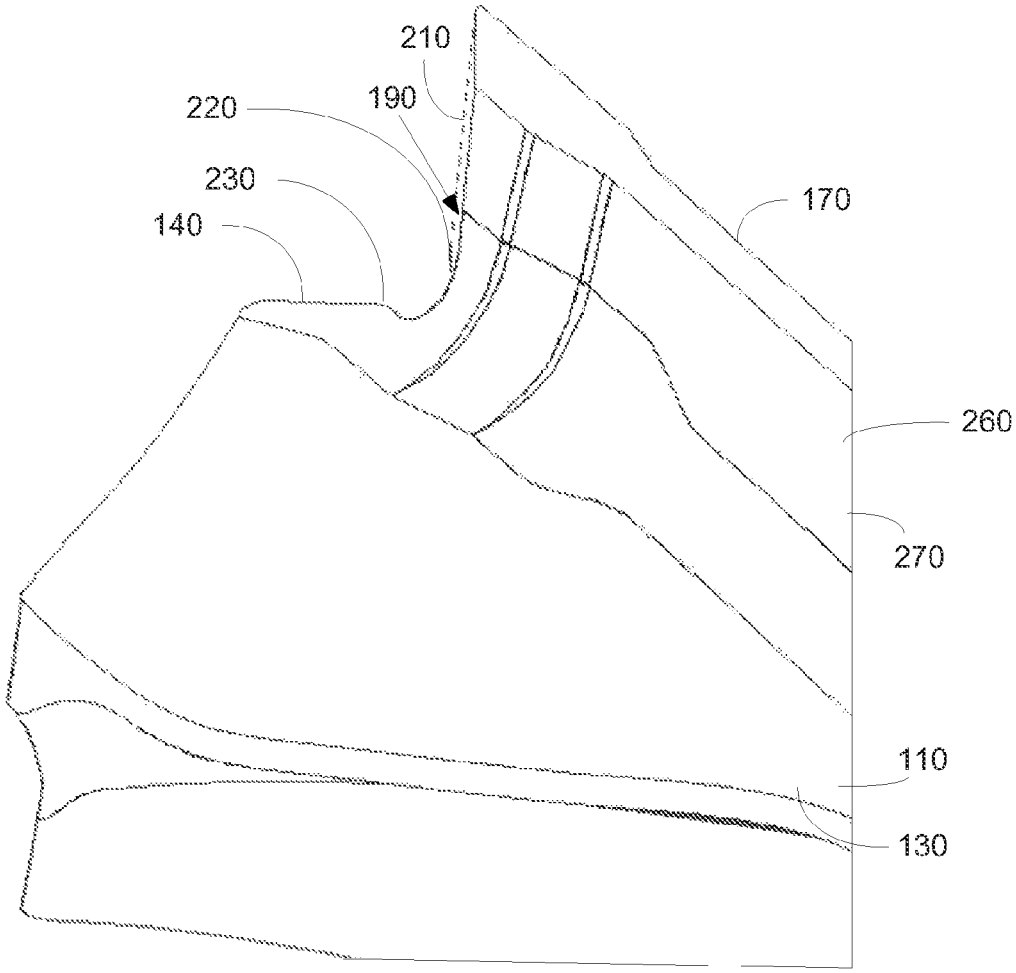
FIG. 5 is a side perspective view of a second side the tip shroud assembly of FIG. 3.

FIGS. 3-5 show an example of an improved tip shroud assembly 100 as may be described herein. Similar to that described above, the tip shroud assembly 100 may include a shroud 110 positioned on the airfoil 60. The shroud 110 may include a first side 120 such as a pressure side and a second side 130 such as a suction side. Likewise, the tip shroud 110 may include a first end Z-notch 140 on a forward end and a second end Z-notch 150 on a trailing end. (Either end may be a forward end or a trailing end. The terms "pressure side", "suction side", "leading end", "trailing end", and the like are used for the purpose of orientation as opposed to an absolute position.) A number of cooling holes (not shown) may extend through the shroud 110. The shroud 110 and the Z-notch 140, 150 may have any desired size, shape, or configuration. Other components may be used herein.

The tip shroud assembly 100 also may include a seal rail 170 positioned on the shroud 110. The seal rail 170 may have any desired size, shape, or configuration. More than one seal rail 170 may be used on the shroud 110. The seal rail 170 may have one or more cutter teeth (not shown) thereon. The cutter teeth may have any desired size, shape, or configuration. The seal rail 170 may extend from the first end Z-notch 140 to the second end Z-notch 150 and may be substantially parallel to the first side 120 and the second side 130.

The seal rail 170 may be attached to the shroud 110 via a number of contoured fillets 190. Specifically, a first side fillet 200 on the first side 120 of the shroud 110 and a second side fillet 210 on the second side 130 of the shroud 110. Each fillet 190 may have a Z-notch section 220 with a number of expanding Z-notch radii 230 and one or more linear sections 260 with a number of substantially uniform linear section radii 270. The Z-notch section radii 230 expand in the direction of the Z-notches 140, 150. The contoured fillets 190 thus transition from the uniform linear section radii 270 of the linear sections 260 to the larger Z-notch section radii 230 about the Z-notches 140, 150 in a reciprocal orientation 280 on either side fillet 200, 210. Other configurations and components may be used herein.

Specifically, the first side fillet 200 thus has the linear section 260 starting with the first end Z-notch 140 and the Z-notch section 220 about the second end Z-notch 150. The Z-notch section 220 has the expanding z-notch radii 230 extending towards the second end Z-notch 150. Likewise, the second side fillet 210 has the reverse arrangement with the linear section 260 starting at the second end Z-notch 150 and extending to the Z-notch section 220 about the first end Z-notch 140. Other sizes, shapes, and configurations may he used herein.

The tip shroud assembly 100 described herein thus uses the expanding Z-notch section radii 230 of the Z-notch sections 220 so as to reduce the stresses about the Z-notches 140, 150. Likewise, the contoured fillets 190 have the smaller linear sections 260 so as to limit the increase in the overall mass of the tip shroud assembly 100. The tip shroud assembly 100 thus provides for improved lifetime with decreases stresses about the Z-notches 140, 150. Overall component lifetime thus may be extended with relatively minor adjustments to geometry. The contoured fillets 190 described herein therefore reduce localized creep about the Z-notches 140, 150 and adjacent shroud surfaces with the larger size and mass of the Z-notch sections 220 with little or no size and mass increase elsewhere for improved lifetime.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A tip shroud assembly for use with a turbine engine, comprising:

a shroud comprising a first end Z-notch and a second end Z-notch;

a seal rail on the shroud; and a contoured fillet attaching the seal rail to the shroud, the contoured fillet comprising a Z-notch section about the first end Z-notch of the shroud and one or more linear sections towards the second end Z-notch of the shroud;

wherein the Z-notch section comprises a plurality of expanding Z-notch radii adjacent to the contoured fillet, the Z-notch radii expanding between the one or more linear sections of the contoured fillet and the Z-notch section about the first end Z-notch, such that a mass of the contoured fillet at the Z-notch section is greater than a mass of the contoured fillet at the one or more linear sections.

2. The tip shroud assembly of claim 1, wherein the plurality of expanding Z-notch radii expands in the direction of the first end Z-notch.

3. The tip shroud assembly of claim 1, wherein the one or more linear sections comprise a plurality of substantially uniform linear section radii.

4. The tip shroud assembly of claim 3, wherein the plurality of expanding Z-notch radii is larger than the plurality of substantially uniform linear section radii.

5. The tip shroud assembly of claim 1, further comprising a first side fillet and a second side fillet.

6. The tip shroud assembly of claim 5, wherein the first side fillet comprises a Z-notch section about the first end Z-notch and the second side fillet comprises a linear section about the first end Z-notch.

7. The tip shroud assembly of claim 5, wherein the first side fillet comprises a linear section about second end Z-notch and the second side fillet comprises a Z-notch section about the second end Z-notch.

8. The tip shroud assembly of claim 5, wherein the first side fillet and the second side fillet comprise a reciprocal orientation.

9. The tip shroud assembly of claim 1, wherein the seal rail comprises one or more cutter teeth.

10. The tip shroud assembly of claim 1, further comprising a plurality of seal rails.

11. The tip shroud assembly of claim 1, wherein a cross-sectional area of the Z-notch section progressively increases from the one or more linear sections towards the first end Z-notch.

12. A tip shroud assembly for use with a turbine engine, comprising:

a shroud;

the shroud comprising a first end Z-notch and a second end Z-notch;

a seal rail positioned on the shroud; and a first contoured fillet on a first side of the seal rail and a second contoured fillet on a second side of the seal rail;

the first contoured fillet comprising a Z-notch section about the first end Z-notch and a linear section about the second end Z-notch wherein the Z-notch section comprises a plurality of expanding Z-notch radii adjacent to the contoured fillet, the Z-notch radii expanding between the one or more linear sections of the contoured fillet and the Z-notch section about the first end Z-notch, such that a mass of the contoured fillet at the Z-notch section is greater than a mass of the contoured fillet at the one or more linear sections.

13. The tip shroud assembly of claim 12, wherein the plurality of expanding Z-notch radii expands in the direction of the first end Z-notch.

14. The tip shroud assembly of claim 12, wherein a cross-sectional area of the Z-notch section progressively increases from the linear section towards the first end Z-notch.

15. The tip shroud assembly of claim 12, wherein the first contoured fillet and the second contoured fillet comprise a reciprocal orientation.

16. A tip shroud assembly for use with a turbine engine, comprising:

a shroud;

the shroud comprising a first end Z-notch and a second end Z-notch;

a seal rail positioned on the shroud; and a first contoured fillet on a first side of the seal rail and a second contoured fillet on a second side of the seal rail in a reciprocal orientation;

the first contoured fillet comprising a plurality of Z-notch radii expanding in the direction of the first end Z-notch and a plurality of substantially uniform linear radii about the second end Z-notch extending through a linear section of the first contoured fillet, such that a cross-sectional area of the contoured fillet progressively increases between the linear section of the first contoured fillet and the first end Z-notch of the shroud.

* * * * *